US006634646B2

(12) United States Patent
Wolpert et al.

(10) Patent No.: US 6,634,646 B2
(45) Date of Patent: Oct. 21, 2003

(54) PORTABLE GAME TABLE

(76) Inventors: Richard Wolpert, 11 Ripley Dr., Northport, NY (US) 11768; Raymond Wolpert, 15 Colony Ct., Greenlawn, NY (US) 11740

( * ) Notice: Subject to any disclaimer, the term of this patent is extended or adjusted under 35 U.S.C. 154(b) by 0 days.

(21) Appl. No.: 10/039,908

(22) Filed: Jan. 2, 2002

(65) Prior Publication Data

US 2003/0122307 A1 Jul. 3, 2003

(51) Int. Cl.[7] ..... A63F 9/00

(52) U.S. Cl. ..... 273/309; 273/283; 273/284; 273/285; 273/287; 446/478

(58) Field of Search ..... 273/309, 287, 273/286, 285, 284, 283; 446/478

(56) References Cited

U.S. PATENT DOCUMENTS

| | | | | | |
|---|---|---|---|---|---|
| 174,958 | A | * | 3/1876 | Homrighausen | 273/285 |
| 734,092 | A | * | 7/1903 | Reed | 273/285 |
| 1,549,610 | A | * | 8/1925 | Reisz | 273/285 |
| 1,595,285 | A | * | 8/1926 | Bevan | 273/282.1 |
| 1,754,130 | A | * | 4/1930 | Uchiyama | 273/285 |
| 1,819,932 | A | * | 8/1931 | Walden | 273/317.3 |
| 2,221,267 | A | * | 11/1940 | Robertson | 273/285 |
| 3,825,264 | A | * | 7/1974 | Dockum | 273/126 R |
| 4,275,887 | A | * | 6/1981 | Tateyama | 273/239 |
| 4,838,179 | A | * | 6/1989 | Bing | 108/132 |
| 4,875,688 | A | * | 10/1989 | Whaley | 273/285 |
| 4,940,242 | A | * | 7/1990 | Tingley | 273/287 |
| 4,967,925 | A | * | 11/1990 | Feniello | 220/524 |
| D314,985 | S | * | 2/1991 | Monneret | D21/11 |
| 4,989,863 | A | * | 2/1991 | Hall | 473/15 |
| 4,995,611 | A | * | 2/1991 | Goldthorpe | 273/123 R |
| 5,050,740 | A | * | 9/1991 | Lucero | 206/579 |
| 5,222,735 | A | * | 6/1993 | Savage | 273/108.53 |
| D343,204 | S | * | 1/1994 | Schramer et al. | 188/149 |
| D347,245 | S | * | 5/1994 | Cecchetti | D21/11 |
| 5,342,057 | A | * | 8/1994 | Sorkoram | 273/239 |
| 5,358,252 | A | * | 10/1994 | McPhaul | 273/241 |
| D352,969 | S | * | 11/1994 | Cecchetti | D21/11 |
| 5,372,364 | A | * | 12/1994 | Arroyo | 273/108.5 |
| 5,413,352 | A | * | 5/1995 | Persidsky et al. | 273/287 |
| 5,417,433 | A | * | 5/1995 | Phillips | 273/309 |
| 5,586,763 | A | * | 12/1996 | De Bono et al. | 273/285 |
| 5,630,760 | A | * | 5/1997 | Brown et al. | 273/108.52 |
| 5,727,787 | A | * | 3/1998 | Salley | 273/284 |
| 5,868,389 | A | * | 2/1999 | Kalivas | 273/286 |
| 5,967,895 | A | * | 10/1999 | Kellen | 463/19 |
| 6,033,014 | A | * | 3/2000 | Nightengale | 297/174 R |
| 6,082,736 | A | * | 7/2000 | Barlow | 273/317.1 |
| 6,105,961 | A | * | 8/2000 | Price | 273/108.52 |
| 6,109,607 | A | * | 8/2000 | Cartwright et al. | 273/108.1 |
| 6,120,030 | A | * | 9/2000 | Chou | 273/284 |
| 6,131,929 | A | * | 10/2000 | Haley | 280/47.34 |
| 6,174,237 | B1 | * | 1/2001 | Stephenson | 463/42 |
| 6,315,293 | B1 | * | 11/2001 | Bush | 273/244.1 |
| 6,502,819 | B2 | * | 1/2003 | Rieber et al. | 273/126 R |
| 6,533,272 | B2 | * | 3/2003 | Hylak et al. | 273/108.31 |

FOREIGN PATENT DOCUMENTS

| | | | | |
|---|---|---|---|---|
| GB | 2 194 452 A | * | 3/1988 | A63F/3/00 |

* cited by examiner

*Primary Examiner*—Benjamin H. Layno
*Assistant Examiner*—Dolores Collins
(74) *Attorney, Agent, or Firm*—Kenyon & Kenyon

(57) ABSTRACT

A portable game table having a protective outer surface when in the closed position. The portable game table includes a game table having an outer surface and a case configured to attach to the game table. A portion of the outer surface of the game table includes a portion of the protective outer surface. The game table may be configured to have a game played thereon, such as football, billiards and air hockey.

12 Claims, 4 Drawing Sheets

PORTABLE GAME TABLE

FIELD OF THE INVENTION

The present invention relates to a game table and, more particularly, to a portable game table which, when in the closed position, has a protective outer surface.

BACKGROUND INFORMATION

Game tables are a popular form of entertainment. Generally, a game table is a game which is free-standing, e.g., it has legs or a base which maintains a game surface at a height which is roughly the same height as a regular table, so that players that are standing adjacent to the game table are suitably positioned to manipulate the game elements on the game surface. Still other game tables do not have legs or a base, and therefore are not free-standing. Instead, they have a game surface which is configured to be placed on an existing flat table top.

Some of the most popular game tables are football, billiards or pool, table or air hockey, etc. For example, FIG. 1 illustrates the game table 10 referred to as "football". In this game, a flat, horizontally-disposed game surface 12 is supported at a height of about three feet by four legs 14. The flat game surface 12 has two vertically-disposed side walls 16 extending upwardly from two opposite outer edges 12*a* of the flat game surface 12 and another two vertically-disposed end walls 18 extending upwardly from the remaining two opposite outer edges 12*b* of the flat game surface 12. The side walls 16 have corresponding through-holes 20. Axially rotatable rods 22 are disposed through the hole 20 of each of the side walls 16. At least one end 22*a* of the rods 22 has a handle 24 which is grippable by a user. The rods 22 also have figures 24 non-rotatably mounted thereon in the region above the flat game surface 12. Each of the end walls 18 has a centrally-disposed opening 26 which functions as a goal.

To play, at least one player (although sometimes more than one player) stands along each of the side walls 16 and grips the handles 24 of the rods 22. Typically, half of the rods 22 are manipulatable by players on one side of the game surface (e.g., these players make up a first team), while the other half of the rods 22 are manipulatable by players on the other side of the game surface (e.g., these players make up a second team). A round ball 28 is placed on the flat game surface 12, and the players of each team manipulate their respective rods 22 in order to strike the ball 28 with the figures 24 mounted on the rods 22. The objective of the game is to strike the ball 28 through the opening 26, or goal, corresponding to the opposing team.

Due to the popularity of these game tables, it is often desirable for them to be portable, so that players can take the game table along with them when they travel. However, most game tables are not sturdy enough to endure the rough handling that they are subjected to when being transported from one location to another.

Thus, there exists a need for an improved apparatus and method for transporting a game table.

SUMMARY OF THE INVENTION

The present invention, in accordance with one example embodiment thereof, relates to a portable game table having a protective outer surface when in the closed position. The portable game table includes a game table having an outer surface. Advantageously, the game table includes a game surface configured to have a game (e.g., football, air hockey, billiards, etc. ) played thereon when in an open position. A case is configured to attach to the game table. The game table and the case are configured such that a portion of the outer surface of the game table comprises a portion of the protective outer surface. In this manner, the size and weight of the case may be reduced, making the game table more practical for transporting to various locations.

Figure 2:
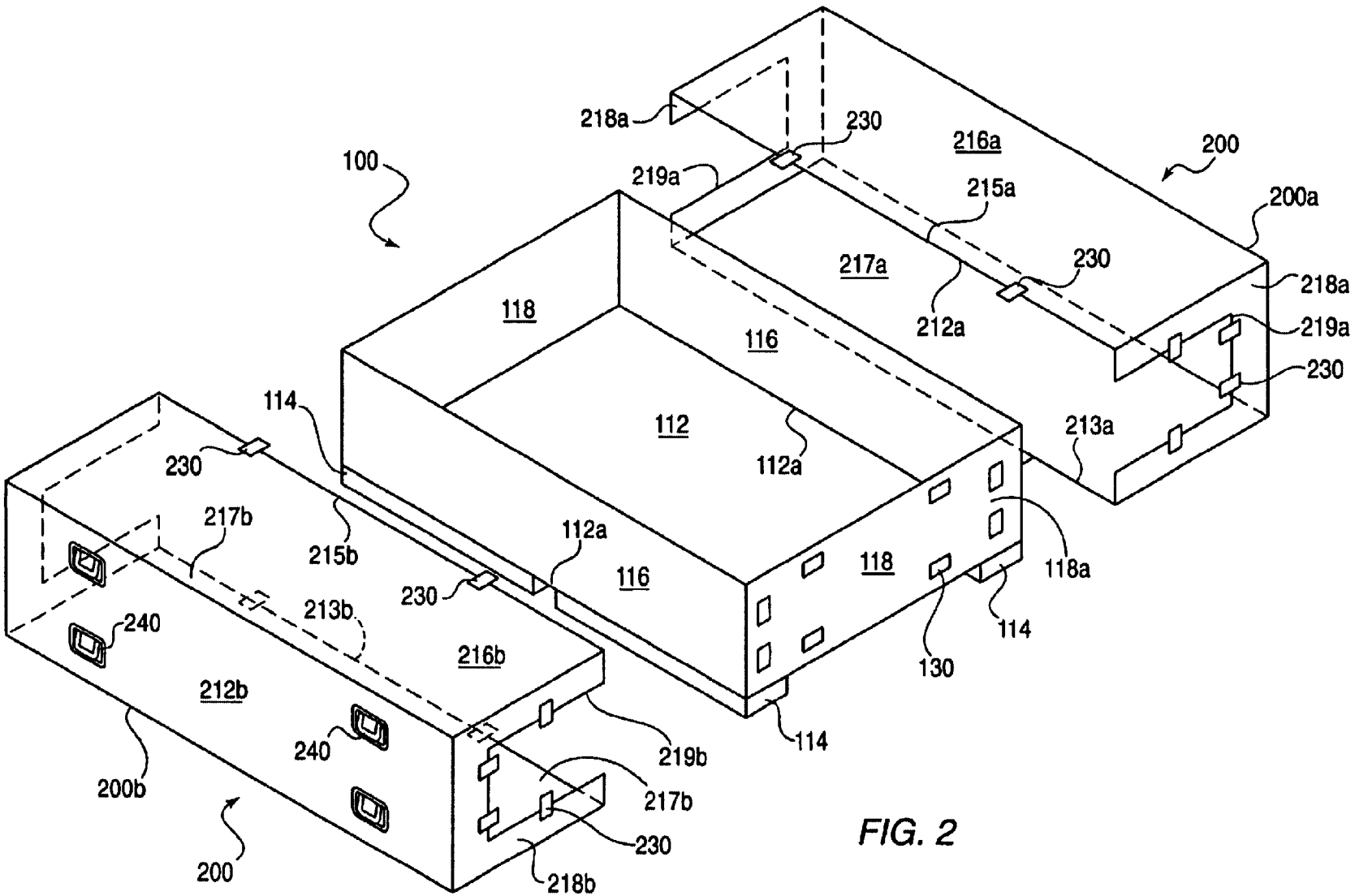
FIG. 2 illustrates a portable game table in an open position, in accordance with one example embodiment of the present invention.
Figure 3:
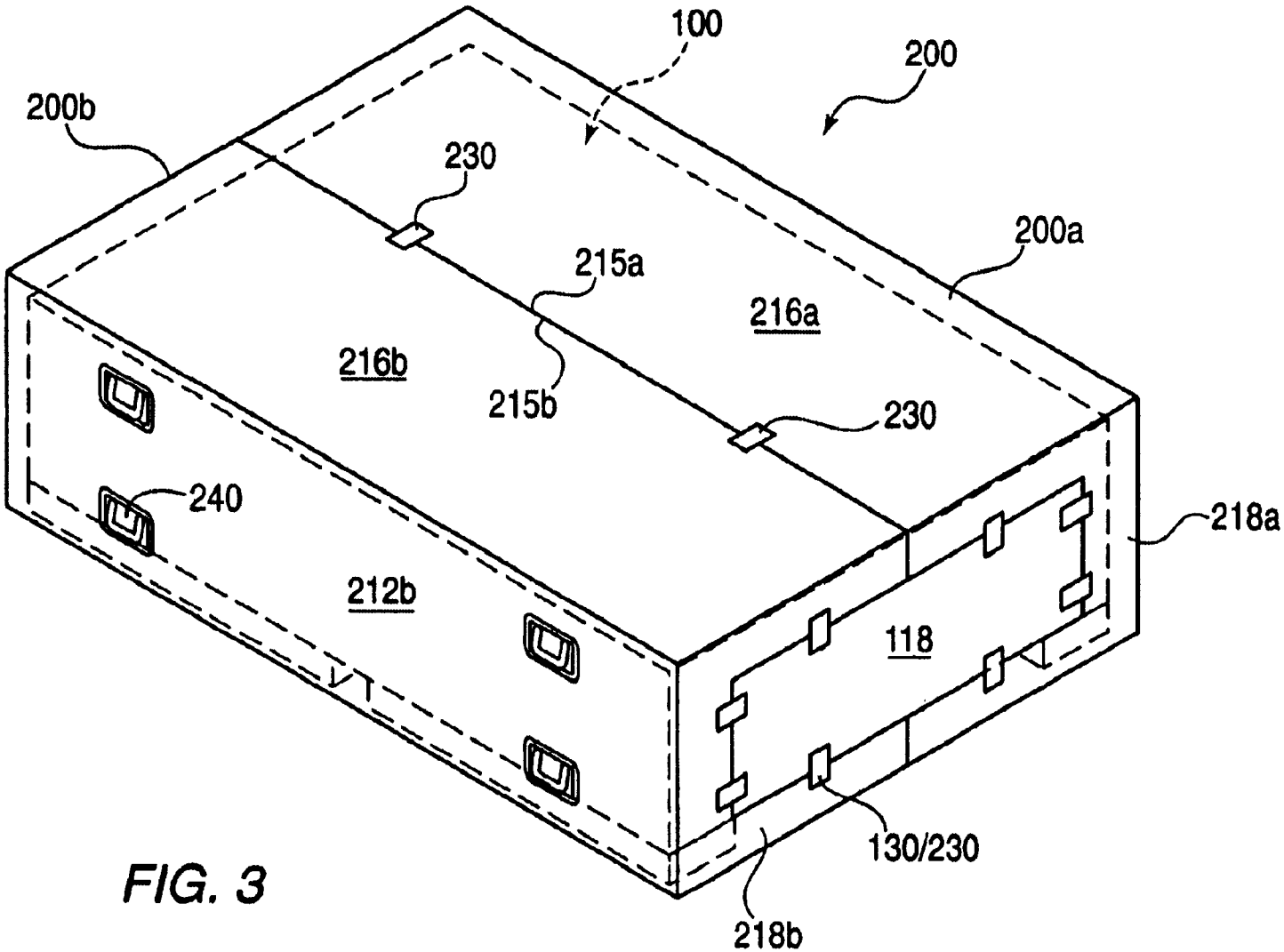
FIG. 3 illustrates the portable game table in a closed position, in accordance with the example embodiment of the present invention shown in FIG. 2.

FIGS. 2 and 3 illustrate a portable game table, in accordance with one example embodiment of the present invention. In this example embodiment, a game table 100 is configured to be enclosed within a case 200. FIG. 2 illustrates the game table 100 having the case 200 in the open position, e.g., disposed adjacent to the game table 100 but not attached to the game table 100. In FIG. 2, the game table 100 includes a flat, horizontally-disposed game surface 112.

The game table is shown in FIG. 2 as having four legs 114, which are folded underneath game surface 112 for storage, and which may be unfolded to support the game table 100 when in use. Of course, it is recognized that, in accordance with alternative embodiments of the present invention, the game table 100 may have legs 114 which are removable or foldable in a different manner for storage purposes, or, if the game table is intended to be placed onto an existing table top during use, the game table 100 may have no legs at all.

The flat game surface 112 of the game table 100 has two vertically-disposed side walls 116 extending upwardly from two opposite outer edges 112*a* of the flat game surface 112 and another two vertically-disposed end walls 118 extending upwardly from the remaining two opposite outer edges 112*b* of the flat game surface 112. An outer surface 118*a* of the end walls 118 have an arrangement of attachment mechanisms 130 disposed thereon.

Figure 1:
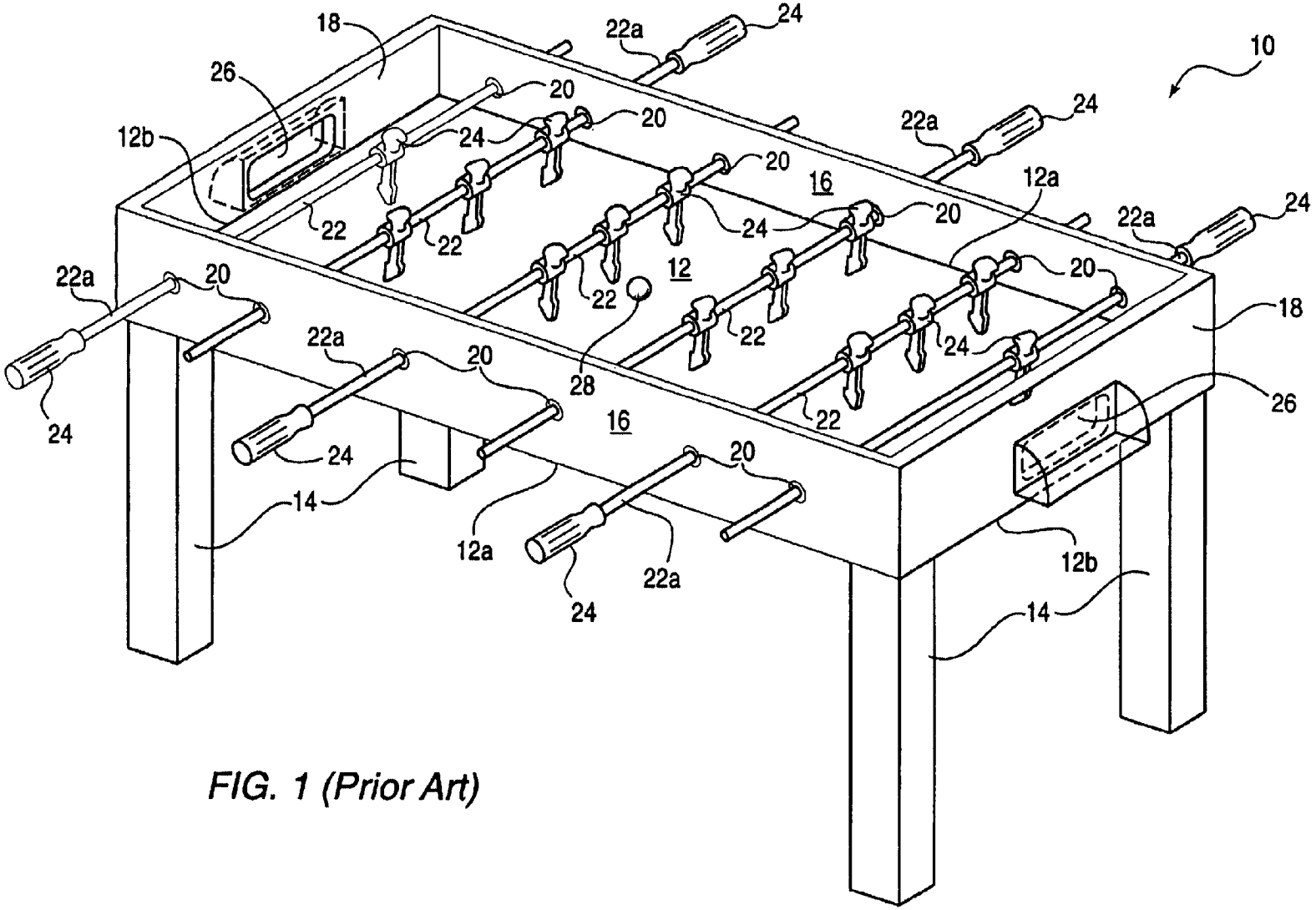
FIG. 1 (Prior Art)
FIG. 1 illustrates a football game table, in accordance with the prior art.

For the purposes of clarity only, the game table 100 is shown in FIG. 2 without the features that are employed to play the game. However, if the game table 100 is a football table, the game table 100 may have all of the game features (e.g., balls, rods, goals, etc.) illustrated in the football game of FIG. 1. Alternatively, if the game table 100 is to be used to play billiards, the game table 100 may include features such as side and corner pockets, balls, pool cues, etc. If the game table 100 is to be used to play air hockey, the game table 100 may include an air pump and air holes, a hockey puck, etc. The present invention is intended to include any conceivable game table, upon which may be disposed the game features which are employed to play the game.

FIG. 2 also illustrates the case 200. In the example embodiment shown, the case 200 includes a first section 200*a* and a second section 200*b*, each of which is roughly symmetrical relative to each other. Advantageously, the case

200 consists of plywood or fiberglass, though any material providing adequate structural rigidity may be employed. Although not shown in FIGS. 2 and 3, the first section 200*a* and the second section 220*b* of the case 200 may include internal padding or baffles that protect the game table 100 when the game table 100 is enclosed within the case 200 (as shown in FIG. 3, which is discussed in greater detail below). In addition, the first section 200*a* and the second section 200*b* of the case 200 may have corners and edges which are reinforced with aluminum or the like, for providing improved structural rigidity and/or for providing additional protection thereto.

As shown in FIG. 2, the first section 200*a* of the case 200 includes a flat, vertically-disposed side wall 212*a*. The flat side wall 212*a* has a horizontally-disposed top wall 216*a* and a horizontally-disposed bottom wall 217*a* extending from two opposite outer edges of the flat side wall 212*a*. Located at various points along the edge 215*a* and on the outer surface of the top wall 216*a* is an arrangement of attachment mechanisms 230. In addition, located at various points along the edge 213*a* and on the outer surface of the top wall 217*a* is another arrangement of attachment mechanisms 230.

In addition, the flat side wall 212*a* has two vertically-disposed end walls 218*a* extending from the remaining two opposite outer edges of the flat side surface 212*a*. Each of the two end walls 218*a* has a cutaway region defined by edges 219*a* . Located at various points along the edges 219*a* and on the outer surface of the end walls 218*a*, is an arrangement of attachment mechanisms 230.

Likewise, the second section 200*b* of the case 200 includes a flat, vertically-disposed side wall 212*b*. The flat side wall 212*b* has disposed thereon several, e.g., four, wheels or casters 240. The flat side wall 212*b* has a horizontally-disposed top wall 216*b* and a horizontally-disposed bottom wall 217*b* extending from two opposite outer edges of the flat side surface 212*b*. Located at various points along the edge 215*b* and on the outer surface of the top wall 216*b* is an arrangement of attachment mechanisms 230. In addition, located at various points along the edge 213*b* and on the outer surface of the top wall 217*b* is another arrangement of attachment mechanisms 230.

In addition, the flat side wall 212*b* has two vertically-disposed end walls 218*b* extending from the remaining two opposite outer edges of the flat side wall 212*b*. Each of the two end walls 218*b* has a cutaway region defined by edges 219*b*. Located at various points along the edges 219*b* and on the outer surface of the end walls 218*b*, is an arrangement of attachment mechanisms 230.

FIG. 3 illustrates the game table 100 and the case 200 of FIG. 2 in the closed position, e.g., whereby the case 200 is attached to the game table 100 thereby enclosing the game surface 112. In the example embodiment shown, in the closed position, the edge 215*a* of the first section 200*a* of the case 200 meets the edge 215*b* of the first section 200*b* of the case 200. With the edges 215*a* and 215*b* in contact with each other, the attachment mechanisms 230 on the top wall 216*a* may engage the attachment mechanisms 230 on the top wall 216*b*, thereby attaching the top wall 216*a* to the top wall 216*b*. Likewise, in the closed position, the edge 213*a* of the first section 200*a* of the case 200 meets the edge 213*b* of the first section 200*b* of the case 200. With the edges 213*a* and 213*b* in contact with each other, the attachment mechanisms 230 on the bottom wall 217*a* may engage the attachment mechanisms 230 on the bottom wall 217*b*, thereby attaching the bottom wall 217*a* to the bottom wall 217*b*. It is noted that, in accordance with various embodiments of the present invention, the attachment mechanisms 230 may include any complementary means for attaching the sections of the case 200 together, and may include, but are not limited to, buckles, belts, latches, etc.

FIG. 3 also illustrates the end walls 218*a* and 218*b* of the first and second sections 200*a* and 200*b*, respectively, which contact the end walls 118 of the game table 100. As illustrated in FIG. 3, the attachment mechanisms 230 that are disposed along the edges 219*a* and 219*b* of the case 200 are configured to engage the attachment mechanisms 130 that are disposed on the outer surface 118*a* of the end walls 118 of the game table 100. In this manner, the case 200 is securely attached to the game table 100, and encloses the game surface 112 of the game table 100.

In this example embodiment, the enclosed game table has an outer protective surface that is comprised of the outer surface of both sections 200*a* and 200*b* of the case 200, as well as a portion of the end walls 118 of the game table 100. By employing a portion of the end walls 118 of the game table 100 as part of the outer protective surface of the enclosed game table, the weight of the case 200 may be reduced. By reducing the weight of the case 200 (and thereby reducing the weight of the enclosed game table when in the closed position) the present invention provides protection to the game table 100 sufficient to withstand the rigors of travel, while reducing the effort required to transport the game table 100. Thus, the practicality of a player transporting the game along with him or her when traveling is increased.

Figure 4:
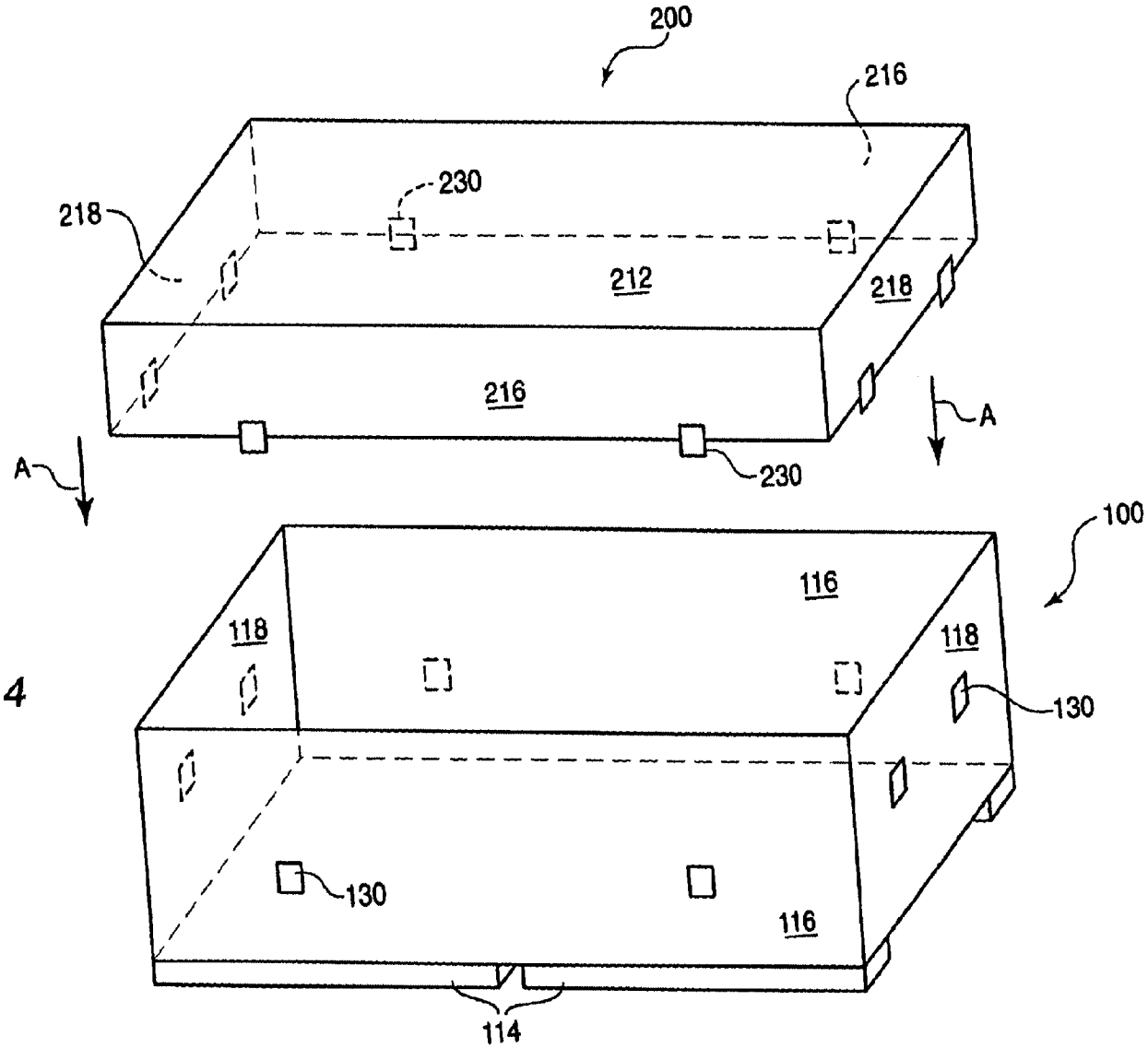
FIG. 4 illustrates a portable game table in an open position, in accordance with another example embodiment of the present invention.

It is noted that, while the example embodiment shown in FIGS. 2 and 3 illustrate the case 200 as comprising two sections 200*a* and 200*b*, alternative embodiments of the present invention may be conceived whereby the case 200 may comprise only one section, or else more than two sections, which employ a portion of the game table 100 as a part of the outer protective surface of the enclosed game table when in the closed position. For instance, FIG. 4 illustrates an alternative example embodiment in which a case 200 comprising a single section is configured to attach to and enclose a game table 100. In this example embodiment, the game table 100 has attachment mechanisms 130 disposed circumferentially around the ends walls 118 and the side walls 116, while the case 200 has attachment mechanisms 230 disposed around the edges of the ends walls 218 and the side walls 216. When the case 200 is moved in the direction illustrated by the arrows A, the attachment mechanisms 130 of the game table 100 engage the attachment mechanisms 230 of the case 200, thereby attaching the case 200 to the game table 100. Of course, it is recognized that in such alternative embodiments, it may be necessary to reinforce those portions of the game table which are part of the outer protective surface so that, when in the closed position, the entire protective outer surface provides an amount of structural rigidity and protection which is sufficient to withstand the rigors of being transported.

It is also noted that, while the example embodiment shown in FIGS. 2 and 3 illustrate the outer surface 118*a* of the end walls 118 of the game table 100 as part of the outer protective surface of the enclosed game table when in the closed position, alternative embodiments of the present invention may be conceived whereby surfaces other than the outer surface 118*a* of the end walls 118 are employed as a part of the outer protective surface of the enclosed game table. The alternative example embodiment illustrated in FIG. 4 shows such an embodiment, whereby the bottom surface 112 of the game table 100, as well as the lower portions of the ends walls 118 and the side walls 116, function as part of the outer protective surface of the enclosed game table when in the closed position. Of course, numerous other such embodiments may be conceived.

Furthermore, it is noted that, while the example embodiment shown in FIGS. 2 and 3 illustrate the case 200 as completely enclosing the game surface 112 of the game table 100, alternative embodiments of the present invention may be conceived whereby the case 200 does not completely enclose the game surface of the game table 100. For instance, referring to FIG. 4, such an alternative embodiment may be achieved by including an opening (not shown) in the top surface 212 of the case 200. Thus, further reduction in the weight-of the case 200 may be achieved by selectively enclosing only a portion of the game surface 112.

Also, it is noted that, while the example embodiment shown in FIGS. 2 through 4 illustrate the game table 100 as having a rectangular shape (and thus also show the case 200 as having a corresponding rectangular shape), alternative embodiments, of the present invention may be conceived whereby the game table 100 and/or the case 200 do not have a rectangular shape. For instance, if the game table 100 is intended for use as an air hockey table, the game table may have an oval shape which duplicates the shape of an actual hockey rink, and the case 200 may have a corresponding oval shape also.

Thus, the several aforementioned objects and advantages of the present invention are most effectively attained. Those skilled in the art will appreciate that numerous modifications of the exemplary embodiments described hereinabove may be made without departing from the spirit and scope of the invention. Although several exemplary embodiments of the present invention have been described and disclosed in detail herein, it should be understood that this invention is in no sense limited thereby and that its scope is to be determined by that of the appended claims.

What is claimed is:

1. A portable game table having a protective outer surface when in the closed position, the portable game table comprising:

a game table having an outer surface, a separate case configured to attach to the game table, wherein a portion of the outer surface of the game table and the case each comprise a portion of the protective outer surface.

2. The portable game table of claim 1, wherein the game table includes a game surface configured to have a game played thereon when in an open position.

3. The portable game table of claim 2, wherein the case is configured to enclose the game surface of the game table.

4. The portable game table of claim 2, wherein the case is configured to partially enclose the game surface of the game table.

5. The portable game table of claim 2, wherein the game table has at least one vertically-disposed wall having an outer surface.

6. The portable game table of claim 5, wherein the outer surface of the at least one vertically-disposed wall comprises a portion of the protective outer surface.

7. The portable game table of claim 1, wherein the case comprises two sections attachable by attachment mechanisms disposed on adjacent edges.

8. The portable game table of claim 1, wherein the game table further includes a plurality of legs, wherein the legs are foldable into a closed position.

9. The portable game table of claim 1, wherein the game table is configured to be placed onto a flat table top.

10. The portable game table of claim 1, wherein the game table is configured to be a football game table.

11. The portable game table of claim 1, wherein the game table is configured to be a billiards game table.

12. The portable game table of claim 1, wherein the game table is configured to be an air hockey game table.

* * * * *